United States Patent [19]

Greiser et al.

[11] Patent Number: 5,017,426

[45] Date of Patent: May 21, 1991

[54] LAMINATE

[75] Inventors: Wolfgang Greiser, Neusäss/Hainhofen; Kurt Plötz, Bobingen; Hans Wagner, Bobingen; Karl-Christian Zerfass, Bobingen, all of Fed. Rep. of Germany

[73] Assignee: Hoechst Aktiengesellschaft, Fed. Rep. of Germany

[21] Appl. No.: 481,885

[22] Filed: Feb. 20, 1990

Related U.S. Application Data

[63] Continuation of Ser. No. 263,536, Oct. 27, 1988, abandoned, which is a continuation of Ser. No. 780,392, Sep. 26, 1985, abandoned.

[30] Foreign Application Priority Data

Sep. 28, 1984 [DE] Fed. Rep. of Germany ..... 3435643

[51] Int. Cl.[5] ..... D04H 1/08

[52] U.S. Cl. ..... 428/280; 428/219; 428/284; 428/285; 428/286; 428/287; 428/297; 428/298; 428/300

[58] Field of Search ..... 428/219, 280, 284, 285, 428/287, 286, 297, 298, 300

[56] References Cited

U.S. PATENT DOCUMENTS 4,755,423 7/1988 Greiser et al. ..... 428/285

*Primary Examiner*—James J. Bell

*Attorney, Agent, or Firm*—Connolly & Hutz

[57] ABSTRACT

A laminate which, when used as a carrier web for roofing and sealing sheets, shows good flammability properties combined with improved mechanical properties and which comprises a layer of synthetic fibers and a layer of mineral fibers is obtained by needling two preconsolidated fiber webs, of which one comprises synthetic fibers and the other mineral fibers. The needling produces a strong positive join of the two webs, as a result of which the tendency for the two layers to delaminate under extreme thermomechanical conditions is avoided.

6 Claims, 1 Drawing Sheet

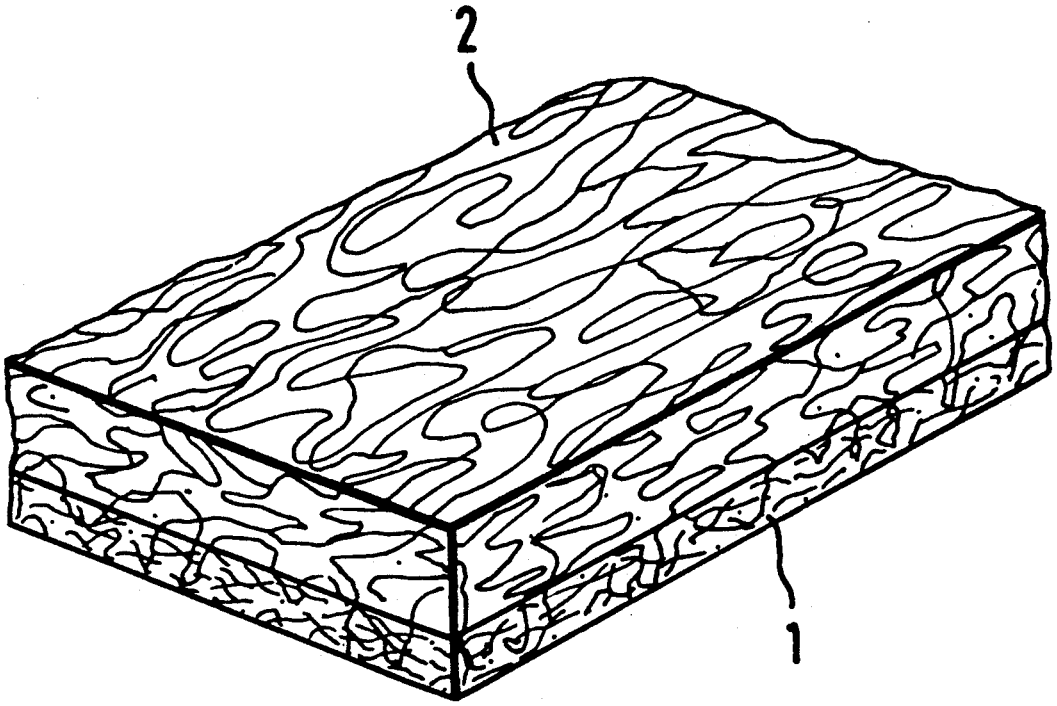
2
1

LAMINATE

CROSS-REFERENCE TO RELATED APPLICATIONS

This application is a continuation of application Ser. No. 263,536, filed Oct. 27, 1988, which is in turn a continuation of application Ser. No. 780,392, filed Sept. 26, 1985 (now abandoned).

The present invention relates to a Laminate having improved mechanical properties and improved fire behavior when used as a carrier web in roofing and sealing sheets. Such roofing and sealing sheets are usually coated with bitumen on one or both sides, but can also have a coating made from elastomers or plastomers.

German Offenlegungsschrift No. 3,226,042 discloses applying to a loose, i.e. unconsolidated, mineral fiber web a thin layer of likewise loose plastics fibers and consolidating this laminate material by needling. By means of a heat treatment it is possible to fuse the plastics fibers to the mineral fibers. This fusing has the effect of producing dimensionally stable mineral fiber blankets.

German utility model No. 7,739,489 discloses as a carrier web for roofing sheets a laminate material comprising a synthetic fiber web and a mineral fiber web. The two layers of synthetic and mineral fiber material are bonded to each other in the reference cited by means of a binder or adhesive, for which thermoplastic and crosslinking thermosetting resins are used.

Such carrier webs lead to roofing and sealing sheets having sufficiently high processing stability in bitumening and in laying. Their dimensional stability even permits single-layer laying on the roof. The fire behavior of these roofing sheets as defined in DIN 4102/part 7 is distinctly improved by the mineral fiber layer.

By contrast, carrier webs made of blend webs of mineral and synthetic fibers of the type described in German Utility Model No. 7,723,547 give no significant improvement of the fire behavior.

The sole disadvantage of the known laminate materials made of a mineral and a synthetic fiber layer remains the tendency for the two layers to delaminate under extreme thermomechanical or mechanical conditions.

It is therefore the object of the present invention to overcome this disadvantage as well while preserving all the advantages of the known laminates for carrier webs for roofing and sealing sheets.

According to the invention, therefore, the laminate which is suitable as a carrier web for roofing and sealing sheets comprises a preconsolidated synthetic fiber web and a preconsolidated mineral fiber web which are bonded to each other by needling.

The synthetic fiber web preferably comprises polyester fibers, usually polyethyleneterephthalate fibers. Particular preference is given to filament nonwovens, namely spunbonds as described for example in German Offenlegungsschrift No. 2,460,755, which in turn are preconsolidated by needling or other methods known per se. This preconsolidation by needling can be effected with a number of needling stitches which amounts to about 10% of the total number of stitches required for joining the two layers making up the laminate according to the invention. Preferred area weights of the filament nonwovens are between 50 and 350 g/m$^2$, and the individual deniers are between 3 and 8 dtex, especially between 4 and 6 dtex.

Preferred mineral fibers webs are glass fiber webs, especially in the form of staple fiber webs. Wet-laid staple fiber webs have proved particularly useful. However, web materials made of ceramic fibers have also proved suitable. The weight of the mineral fiber webs is usually between 10 and 100 g/m$^2$, preferably between 30 and 60 g/m$^2$. Such webs are described for example in European Offenlegungsschrift No. 19,465, European Offenlegungsschrift No. 25,115 and German Offenlegungsschrift No. 3,143,586. EP-A 19465 describes a binder to hold the fibrous materials together (Page 5, lines 19–20), and EP-A 25115 also discloses such a binder (page 5, lines 8–10). To prepare the laminate according to the invention, the two preconsolidated webs are needled to each other using known methods. The needling should comprise 10 to 100 stitches/cm$^2$, preferably between 20 and 50 stitches/cm$^2$. This needling is carried out in such a way that the needles first enter the synthetic fiber web and then penetrate through the material fiber web underneath. The depth of a stitch naturally depends on the thickness of the webs. It is between 6 and 11 mm and leads to a strong positive join of the synthetic fiber web to the mineral fiber web by means of synthetic fibers pulled through the latter.

The accompanying drawing shows a section of the laminate according to the invention, in which 1 denotes the mineral fiber web and 2 the synthetic fiber web.

We claim:

1. A laminate as a carrier web for roofing and sealing sheets made of a layer of synthetic fibers and a layer of mineral fibers, comprising a non-woven of synthetic fiber preconsolidated by needling or by a binder and a nonwoven of mineral fiber preconsolidated by needling or by a binder which, after preconsolidation, are bonded to each other by needling, wherein the weight of the synthetic fiber nonwoven is 50 to 350 g/m$^2$, and the individual denier is a 3 to 8 dtex, the mineral fiber nonwoven has a weight between 30 to 60 g/m$^2$, and wherein 10 to 100 needling stitches per cm$^2$ have been applied.

2. The laminate as claimed in claim 1, wherein the synthetic fiber nonwoven comprises polyethylene terephthalate fibers.

3. The laminate as claimed in claim 1, wherein the mineral fiber nonwoven is a wet-laid staple fiber nonwoven.

4. The laminate as claimed in claim 1, wherein 20 to 50 needling stitches per cm$^2$ have been applied.

5. A laminate as a carrier web for roofing and sealing sheets made of a layer of synthetic fibers and a layer of mineral fibers, comprising a non-woven of synthetic fiber preconsolidated by a binder and a nonwoven of mineral fiber preconsolidated by a binder which, after preconsolidation, are bonded to each other by needling, wherein the weight of the synthetic fiber nonwoven is 50 to 350 g/m$^2$, and the individual denier is 3to 8 dtex, the mineral fiber nonwoven has a weight between 30 and 60 g/m$^2$, and wherein 10 to 100 needling stitches per cm$^2$ have been applied.

6. A laminate as a carrier web for roofing and sealing sheets made of a layer of synthetic fibers and a layer of mineral fibers, comprising a non-woven of synthetic fiber preconsolidated needling and a nonwoven of mineral fiber preconsolidated by a binder which, after preconsolidation, are bonded to each other by needling, wherein the weight of the synthetic fiber nonwoven is 50 to 350 g/m$^2$, and the individual denier is 3 to 8 dtex, the mineral fiber nonwoven has a weight between 30 and 60 g/m$^2$, wherein 10 to 100 needling stitches per cm$^2$ have been applied.

* * * * *